US006250194B1

(12) United States Patent
Brandl et al.

(10) Patent No.: US 6,250,194 B1
(45) **Date of Patent: *Jun. 26, 2001**

(54) MULTIPURPOSE WEAPON

(75) Inventors: Rudolf Brandl, Dornhan; Heinz Matt, Oberndorf, both of (DE)

(73) Assignee: Heckler & Koch GmbH (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/018,285

(22) Filed: Feb. 4, 1998

Related U.S. Application Data

(63) Continuation-in-part of application No. 08/826,469, filed on Mar. 27, 1997, now abandoned.

(30) Foreign Application Priority Data

Mar. 17, 1997 (EP) ..... 97104545

(51) Int. Cl.[7] ..... F41A 19/21

(52) U.S. Cl. ..... 89/1.41; 89/127; 42/71.01; 42/72; 42/100; 42/75.01

(58) Field of Search ..... 89/1.41, 126, 127, 89/43.01; 42/72, 71.01, 105, 75.01, 100

(56) References Cited

U.S. PATENT DOCUMENTS

| | | | | |
|---|---|---|---|---|
| 1,202,707 | | 10/1916 | Grieco . | |
| 1,339,867 | | 5/1920 | Strickland . | |
| 1,487,801 | | 3/1924 | Pedersen . | |
| 3,279,114 | | 10/1966 | Lewis et al. . | |
| 3,641,691 | | 2/1972 | Ellis et al. . | |
| 3,757,446 | | 9/1973 | Vesamaa . | |
| 4,439,943 | * | 4/1984 | Brakhage | 42/74 |
| 4,679,486 | | 7/1987 | Landaas | 89/126 |
| 4,689,911 | | 9/1987 | White | 42/105 |
| 4,733,489 | * | 3/1988 | Kurak | 42/105 |
| 4,882,973 | * | 11/1989 | Piscetta | 89/1.41 |
| 5,555,662 | | 9/1996 | Teetzel | 42/103 |
| 6,012,374 | | 1/2000 | Brandl et al. | 89/127 |

FOREIGN PATENT DOCUMENTS

| | | | |
|---|---|---|---|
| 148516 | 1/1937 | (AT) . | |
| 1944650 | 3/1971 | (DE) | 42/105 |
| 3202806C2 | 7/1997 | (DE) . | |
| 565530 | 11/1944 | (SE) . | |

OTHER PUBLICATIONS

Alliant Tech Systems; "No Place to Hide"; 5 pages, Mar. 1998.*

* cited by examiner

*Primary Examiner*—Stephen M. Johnson
(74) *Attorney, Agent, or Firm*—Leydig, Voit & Mayer, Ltd

(57) ABSTRACT

A multipurpose weapon having a self-loading large-caliber self-loading rifle module or section and an assault weapon module or section attached to the front portion of the large caliber rifle is provided. A first trigger assembly of the large-caliber rifle is positioned for operation by a trigger hand of the user of the weapon, while a second trigger assembly of the assault weapon module is configured for operation by the non-trigger hand of the user. Alternatively, the assault weapon section or module can be equipped with a trigger that is selectively operable to fire either the assault weapon module or the large-caliber rifle module. Additionally, a detachable secondary module comprising a grip module which includes a grip and a trigger can alternatively be attached to the large-caliber module.

7 Claims, 2 Drawing Sheets

MULTIPURPOSE WEAPON

This application is a continuation-in-part of application Ser. No. 08/826,469 filed on Mar. 27, 1997, now abandoned, the subject matter of which is incorporated herein in its entirety.

FIELD OF THE INVENTION

This invention relates generally to the weaponry art, and more particularly to a multipurpose weapon including a large caliber self-loading rifle module and an auxiliary or secondary module which can be selectively attached to the rifle module based upon the desired use of the weapon.

BACKGROUND OF THE INVENTION

One known multipurpose weapon is a standard assault rifle equipped with a grenade launcher barrel mounted thereon, and is described in German patent DE 32 02 806 C2. That multipurpose weapon includes a conventional rapid-fire weapon having a grip piece, a conventional trigger arrangement and a relatively short grenade launcher barrel mounted to the distal end of the shaft portion of the rifle barrel. The grenade launcher barrel is equipped with a separate breech block and trigger assembly. The rear end of the grenade launcher barrel can be swung downward to remove a spent cartridge and to reload the grenade launcher. Adjacent the rear end of grenade launcher barrel is a grooved outer surface which functions as the front shaft of the combined weapon. Operating elements in the form of a locking slide and a trigger are located above the grooved outer surface. Those operating elements are operable by one hand of the user gripping the grooved outer surface. The other hand of the user is used to hold the grip of the assault rifle and to operate the trigger, safety device, and other operating elements of the assault weapon.

This arrangement provides suboptimal orientation of recoil impact forces, particularly when the grenade launcher is utilized. The position of the normal-caliber assault rifle barrel with respect to the shoulder support of the weapon is arranged such that the recoil force is transferred in a desirable manner to the shoulder of the user. The barrel of the grenade launcher, which produces greater recoil, is positioned underneath the barrel of the assault rifle and is therefore suboptimally positioned with respect to the shoulder support. The recoil generated by the operation of the grenade launcher is therefore transferred in a less-than-optimal fashion to the shoulder support and can affect the accuracy of aiming the grenade launcher and firing.

The loading process of the grenade launcher barrel is also rather problematic. A cartridge introduced into the downward tilted (and therefore obliquely positioned) barrel has the tendency to slip out of the cartridge chamber before the user can counter-rotate the barrel back to the operating position. If the user attempts to hold the cartridge in the barrel while pivoting the barrel upward, his fingers are susceptible to being pinched between the breech block and the barrel of the grenade launcher.

Furthermore, a second magazine is often attached beside the magazine in use with an isolating band or the like in order to facilitate a faster magazine change for the assault rifle. The second magazine necessarily extends downward and hinders the reloading of the grenade launcher barrel.

With this arrangement the grenade-launching barrel with its breech is fixedly mounted to the assault rifle and cannot and should not be removed. In addition, due to its high recoil, the grenade-launching system could not be fired with the stock of the assault rifle removed without injuring the user.

Another known multi-purpose rifle is described in European patent application 0 294 346. This multipurpose rifle includes a repeating shotgun and a submachine gun which are also combined to form an integrated multi-purpose rifle. The large-caliber system is adapted solely for firing shot, rubber projectiles or the like and is suitable for firing non-spin-stabilized projectiles only at very short range. The submachine gun portion is intended for longer range fire, however, the cartridges used for the ammunition have low ballistic efficiency. One of the disadvantages of this system is that the shotgun and submachine gun portions of the weapon are substantially inseparable.

A further multi-purpose rifle known to the applicant includes a simple repeating rifle, e.g. the kind used as a military rifle during World War I, into which a submachine-gun system is integrated. Once again, a disadvantage of this weapon is that the submachine-gun portion cannot be disassembled and reassembled quickly and easily by a user. In particular, each time the submachine gun portion is reassembled it has to be laboriously aligned with the sight of the repeating-rifle portion. Moreover, the infantry rifle portion has a caliber on the order of only approximately 20 mm and thus is not suitable for large-caliber cartridges.

Although past efforts to combine rifle barrels of different calibers generally have produced unsatisfactory results, the need for such combination weapons exists. For example, large-caliber rifle cartridges that deploy so called "intelligent ammunition" have been developed. As used herein, "intelligent ammunition" is intended to mean a type of ammunition which, possibly in cooperation with a guidance system mounted on the weapon, automatically and independently locks onto a target, thereby providing considerably improved targeting accuracy. The combination of a weapon capable of firing such intelligent ammunition with an assault rifle provides a resulting weapon that is very versatile and very powerful.

The projectiles of intelligent ammunition typically have an initial velocity that is much higher than that of the cartridges for the grenade launcher described above. It is well known that the muzzle energy achievable in a hand-held firearm is limited by the recoil impulse that the user can withstand. This impulse is reduced when its duration is lengthened such as by means of the recoil of a breech block after the firing. In order not to exceed the impulse tolerance limit of average users, the firing of large-caliber intelligent ammunition cartridges requires a weapon with a breech block, such as a self-loading rifle.

Because of the good targeting accuracy and high effectiveness of hit performance (typically within 1000 meters) of the intelligent ammunition described above, it is desirable to equip at least one or two soldiers in an infantry unit with large-caliber self-loading rifles capable of firing intelligent ammunition even though the rifle and the ammunition tend to be heavy. Nevertheless, due to the increased weight of the ammunition and its resultant high recoil, it is not practical to operate such a self-loading rifle in a continuous-firing mode. The firing strength of an infantry unit is seriously weakened if two soldiers in the group are not capable of maintaining continuous firing. It is possible to ameliorate this problem by equipping a soldier carrying a large-caliber rifle with a pistol. Such an approach is not satisfactory, however, since the soldier is required to carry a second weapon which must be separately handled, and requires handling of corresponding cartridges. Likewise, it is not recommended to equip such a soldier with a submachine gun, or an assault weapon since such auxiliary equipment can be overly heavy and cumbersome as to severely restrict the movement of the soldier.

SUMMARY OF THE INVENTION

Accordingly, it is a general object of the present invention to provide a multipurpose weapon that is capable of firing cartridges of different sizes and that is relatively simple in construction and easy to use and handle, to provide a greater degree of self-defense as compared to known weaponry.

It is a more specific object of the invention to provide a self-loading multipurpose weapon capable of firing both normal-caliber and large-caliber cartridges that is easy to reload and easy to operate, and allows the user the choice of firing either type of cartridges at any time during operation.

It is another object of the present invention to provide a self-loading multipurpose weapon for firing both normal-caliber and large-caliber cartridges that has improved recoil characteristics as compared to known weaponry.

It is an object of the present invention to provide a self-loading multipurpose weapon capable of firing both normal-caliber and large-caliber cartridges that is simple in structure and relatively light in weight so that the rifle is easy to manufacture, simple to maintain, and convenient to carry.

It is a related object of the present invention to provide a multipurpose weapon that has a relatively simple triggering mechanism and a straightforward sighting arrangement.

It is a further object of the present invention to provide a multipurpose weapon as characterized above that can be disassembled and reassembled quickly and easily.

It is another object of the present invention to provide a multipurpose weapon as characterized above that can be adapted quickly and easily for different operating situations.

It is a more specific object of the present invention to provide a multi-purpose weapon of the foregoing type which can be adapted as desired to operate simply as a large caliber rifle or simply as an assault rifle.

In accordance with these and other additional objects, a multipurpose weapon of the present invention comprises a base or large-caliber rifle module and a quasi-auxiliary or secondary module comprising an assault weapon module which is preferably mounted proximate to the fore end of the base module housing. The large-caliber rifle module has a housing with a shoulder support at one end, a longitudinally extending barrel disposed at least partially within the housing opposite the shoulder support adapted to fire large-caliber cartridges, and a trigger assembly depending from the housing. The assault weapon module is preferably disposed subjacent to the base module and comprises an assault weapon housing and an assault rifle barrel at least partially disposed within the housing oriented parallel to the large-caliber barrel. In this regard, the length of the assault weapon module is preferably less than that of the base module such that the assault weapon module is disposed in complemental positional relationship therewith. The assault weapon module also includes a self-loading system and novel trigger assembly disposed in the assault weapon housing.

In accordance with one particular feature of the invention, the assault rifle housing is releasably attached to the base module housing. In addition, the assault weapon housing further provides a hand support which can be gripped by the non-trigger hand of the user to support the fore end of the weapon. The trigger assembly of the large-caliber rifle module is disposed at a proximal operation position for manipulation by the trigger hand of the user. The trigger assembly of the assault weapon module is disposed at a distal operation position sufficiently close to the hand support for ready hand manipulation by the non-trigger hand of the user.

One of the features of the invention is that the resulting weapon provides two weapon modules having barrels of different bore diameters, each with a dedicated self-loading system. The weapon may be used primarily as a large-caliber military rifle, but also has the rapid-firing capability of a conventional assault rifle.

Another feature of the invention is that both modules are disposed in a ready-to-fire position with respective trigger assemblies disposed for manipulation by an operator holding the weapon in a regular fashion. Thus, the operator can wield a single weapon which provides the versatility and freedom of choice of multiple weapons.

In a further embodiment of the present invention, the secondary module may include the trigger for the large-caliber module. In this embodiment, the large-caliber module includes only a firing mechanism or, more particularly, the portion of the trigger assembly necessary for priming and stopping. When the multipurpose weapon is to be used exclusively as a large-caliber rifle, the secondary module can simply comprise a grip assembly which includes a trigger as well as operating elements for the electronics and sight of the large-caliber module. Alternatively, the secondary module can comprise an assault-rifle module which is equipped with a mechanism by which the trigger of the assault-rifle module can be selectively switched to either the large-caliber or assault-rifle module. The assault-rifle module also can be configured such that it can function independently of the large-caliber rifle as a stand alone assault rifle.

Other objects and advantages will become apparent with reference to the following detailed description when taken in conjunction with the drawings, in which:

Figure 1:
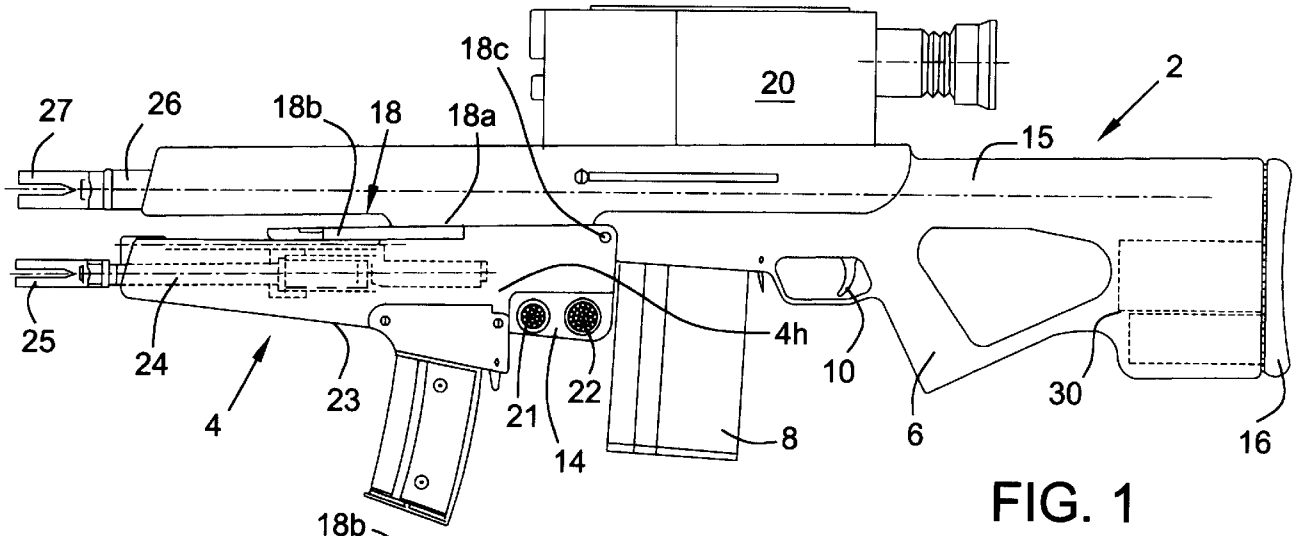
FIG. 1 is an elevation view of one preferred embodiment of a multipurpose weapon of the invention comprising a large-caliber rifle module and an assault weapon module attached thereto.

While the invention is susceptible of various modifications and alternative constructions, certain illustrated embodiments hereof are shown in the drawings and will be described below. It should be understood, however, that there is no intention to limit the invention to the specific embodiments disclosed herein. To the contrary, the invention is intended to cover all modifications, alternative constructions and equivalents falling within the spirit and the scope of the invention as defined by the appended claims.

DETAILED DESCRIPTION OF THE PREFERRED EMBODIMENT

Generally, the present invention relates to a weapon that includes a base module or non-conventional caliber rifle section adapted to fire non-conventional cartridges while minimizing strain to the user from recoil forces. In one preferred embodiment, the weapon also includes a complemental "quasi-auxiliary" or secondary module comprising an assault rifle section connected to the base module and adapted to fire conventional cartridges. The weapon provides greater flexibility to the user with reduced overall weight.

In describing the specific preferred embodiments of the invention, positional terms such as "fore," "above," "under," or the like are used to describe the relative positions of the preferred components of the multipurpose weapon as presented in the drawings when the weapon is oriented in a horizontal firing position with the muzzles of the weapon disposed forward. Such positional terms are used for illustration purposes only and are not intended in any way to limit the scope of the present invention.

FIG. 1 shows a multipurpose weapon embodying the present invention. Generally, the multipurpose weapon comprises a base module 2 and a "quasi-auxiliary" or assault weapon module 4. The base module 2 is preferably a non-conventional caliber self-loading rifle which is adapted to fire non-conventional or large-caliber cartridges. By way of example, such non-conventional cartridges may include "intelligent ammunition" or other ammunition of increased diameter. The base module is a complete weapon in itself, comprising a rifle housing 15 and a longitudinally extending rifle barrel 26 contained in the housing 15 and adapted to fire large-caliber cartridges. A self-loading system is also contained within the housing 15 as will be understood by those skilled in the art.

The housing 15 is formed to provide a stock or shoulder support 16 and its opposed end and a grip piece 6 intermediate to the barrel 26 and the shoulder support 16. In order to reduce the magnitude of recoil impact on the shoulder of the user, a shock absorber 30 is disposed in the butt of the large-caliber rifle adjacent the shoulder support 16. FIG. 1 also shows a mounting arrangement 18 disposed on the bottom of the housing proximate to its fore end. As described below, the mounting arrangement 18 provides a fastening location for the assault weapon module.

Figure 2:
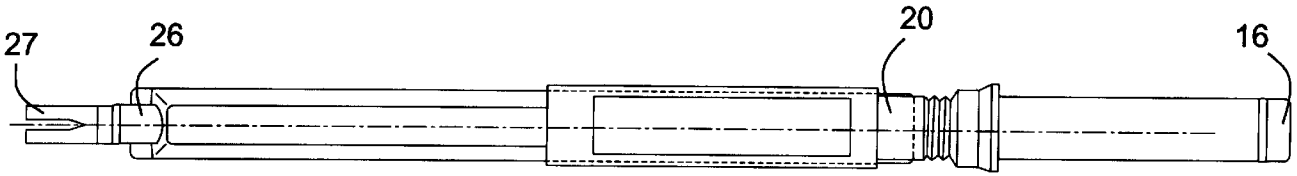
FIG. 2 is a top view of the multipurpose weapon of FIG. 1.

FIG. 1 also shows the assault weapon or quasi-auxiliary module 4 mounted to the base module housing 15 subjacent to the non-conventional barrel 26. In the preferred embodiment, module 4 is an assault weapon adapted to fire conventional caliber rifle cartridges. The module 4 is similarly a functionally separate weapon, and includes an assault weapon housing 4h, an assault rifle barrel 24 at least partially contained within the housing 4*h*, and a self-loading system of the known type, except that it includes and a novel trigger arrangement 14. As seen in FIGS. 1 and 2, the assault weapon module 4 preferably has a relatively short length as compared with the base module. In this regard, the module 4 does not provide any shoulder support or grip in the preferred implementation.

In the embodiment illustrated in FIG. 1, the large-caliber rifle 2 has a rod magazine 8 depending from the housing 15, spaced from the trigger 10, which contains non-conventional or large-caliber cartridges. The assault weapon module 4 also has a (slightly curved) rod magazine 12 depending from the housing 4*h*, which contains rifle cartridges of a conventional size, such as 0.233 inches diameter or the like.

As noted above, the sides and bottom portions of the auxiliary module housing 4*h* intermediate the rod magazine 12 and the assault rifle muzzle 25 are adapted to provide a hand guard 23 which may be used to support the front end of the weapon during aiming and shooting. For example, the housing 4*h* may be sloped or curved as shown in FIGS. 1 and 2 to present a comfortable gripping surface for the non-trigger hand of the user.

Rather than using a conventional trigger and safety switch, the assault weapon module 4 of present invention employs an actuating or trigger assembly 14 with a trigger pushbutton 21 and a safety pushbutton 22. These permit ready finger access and manipulation by the non-trigger hand of the user for ease of operation. The actuating assembly 14 is preferably designed as a sub-module which is readily installed into or removed from the assault weapon module housing.

Figure 3:
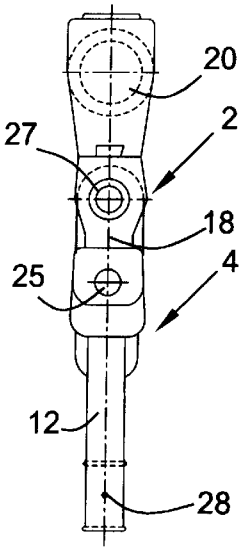
FIG. 3 is a front view of the multipurpose weapon of FIG. 1.

FIGS. 1 and 3 also show a single sighting device 20 which is mounted to the top side of the large-caliber housing 15. As best seen in FIG. 3, the sighting device 20, the large-caliber barrel 26, and the assault rifle barrel 24 have their respective axes aligned in the same vertical plane 28. The sighting device 20 may be implemented, for example, as a telescopic sight with luminous point coincidence capability. When intelligent ammunition rounds are fired, the sighting device may be further equipped with an acoustic distance meter and an electronic guiding device for guiding the flight of the intelligent ammunition projectiles.

In accordance with one feature of the invention, the assault weapon module 4 excludes any stock or shoulder support. Accordingly, its overall length is sufficiently reduced to facilitate mounting to the forward section of the base module housing 15 in underlying relation to the housing 15 and rifle barrel 26. Accordingly, the assault weapon module is located forward of the large-caliber magazine 8, while its own cartridge magazine 12 protrudes downwardly only slightly beyond that of magazine 8. The resulting structure is a compact, east-to-handle design. The elimination of the shoulder support also reduces the weight of the combined weapon.

Figure 4:
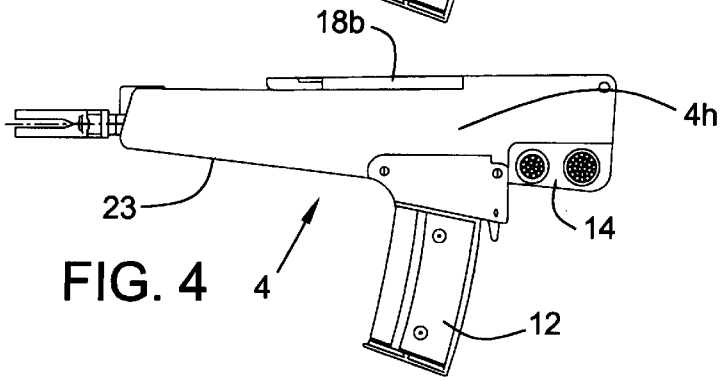
FIG. 4 is a side view of the assault weapon module.

As illustrated in FIG. 1, the assault weapon is releasably engaged with the mounting arrangement 18 on the underside of the large-caliber rifle housing 15, spaced from the large-caliber cartridge magazine 8. The mounting arrangement 18 retentively engages the assault weapon module 4 with the use of cooperating members which allow secure attachment of the assault weapon module to the large-caliber rifle. The slide-on mounting arrangement is constructed, for example, with complementary tongue-and-groove pieces 18*a*, 18*b* disposed on the underside of the large-caliber rifle housing 15 and the top-side of the assault weapon housing 4*h*, respectively. A detent pin passes 18*c* transversely through an opening formed in the large-caliber rifle housing 15 and an opening formed in the assault weapon housing 4*h* to secure the module 4 in place. FIGS. 1 and 4 illustrate the piece 18*b* as a tongue piece that slidably engages groove piece 18*a* located on the base module housing. Other types of slide-on mounting arrangements such as complementary swallowtail pieces or the like that permit sliding releasable engagement may also be utilized, as are commonly used for mounting telescopic sights to the rifle housing 15.

When the quasi-auxiliary module is in place, the large-caliber rifle barrel 26 overlies the assault weapon barrel 24. The muzzles 25, 27 of the respective barrels 24, 26 are preferably aligned such that the muzzle ends are substantially the same distance from the shoulder support 16, oriented in the same vertical plane 28. As can be best seen in FIGS. 2 and 3, the assault weapon module 4 construction and manner of mounting to the underside of the large-caliber rifle housing 15 provides an overall structure with relatively flat side surfaces so that a user can carry it comfortably by means of a shoulder strap.

One advantage of the mounting arrangement utilized is that the angle and position of the assault weapon module 4 is fixed with respect to the large-caliber rifle 2. Such rigid mounting ensures that the connection between the two modules will not be inadvertently separated or otherwise disengaged. This was impossible to achieve to a full degree in the prior art combination of an assault rifle and a grenade launcher described above, because the recoil of the grenade launcher used therein is too great to permit such a mounting.

The releasable feature of the mounting arrangement 18 has the further advantage that the respective modules of the combined weapon can be easily separated and disassembled to allow replacement of defective parts or even an entire module as desired. It also allows each module to be used separately or in combination with other types of modules or components. For instance, the large-caliber rifle 2 without the assault weapon module 4 attached thereto can be mounted on a bipod or a gun-carriage type stand. Similarly, the assault weapon module 4 can readily be mounted to other weaponry such as a bazooka or anti-tank hardware, or on the barrel of a light-recoil (or recoil-free) gun as a substitute for a coaxial machine gun. Alternatively, it can be mounted as a stationary weapon on, for example, an armored vehicle for zone sweeping while lying in the fire shadow of the on-board weapon.

As illustrated in FIG. 1, the large-caliber rifle 2 and the assault weapon module 4 each has a cartridge magazine mounted transversely to the firing direction of the weapon (i.e., the axial direction of the barrels). Since the magazines 8, 12 of the respective modules are axially spaced from each other, the likelihood of interference is reduced even when the user fastens a spare magazine on either one of them.

In accordance with another feature of the present invention, the recoil characteristics of the large-caliber rifle are optimized to allow the user to shoot with precision. This is accomplished with the position of the large-caliber barrel 26, the position and construction of the shoulder support 16, and the grip 6 which are designed to distribute recoil impact forces of the large-caliber rifle 2 to the shoulder of the user upon firing.

Due to the separation between the assault weapon barrel 24 and the large-caliber rifle barrel 26, the recoil impact forces of the assault weapon are applied in an oblique direction to the shoulder support 16. The recoil of assault weapon 4 is therefore not optimized as that of the large-caliber rifle 2. However, the recoil of an assault weapon module, designed for modern cartridges of a small caliber such as .223 or smaller, is much less than that of the large-caliber rifle. Accordingly, such recoil does not cause significant strain on the shoulder of the user and has a very slight or no effect on targeting precision.

One feature of the present embodiment is the utilization of actuating pushbuttons in the trigger subassembly 14 of the assault weapon 4. As shown in FIG. 1, first and second pushbuttons 21, 22 are mounted to be movable in a direction transverse to the firing direction of the assault weapon. Normally the non-trigger hand of the user (holding the hand guard 23 on the assault weapon) is used to support the front portion of the combined weapon and control the orientation of the weapon in aiming and firing. The use of a conventional trigger would require the user to remove his hand from the supporting position to the trigger in order to actuate the trigger. Such movement tends to inadvertently change the orientation of the weapon and cause the user to lose his aim on the target. With the pushbutton trigger 21, very slight finger movement is required to actuate the trigger, while maintaining firm support and control of the front end of the weapon. Thus, inadvertent swinging movement of the weapon during aiming and actuation of the trigger is minimized. Preferably, the trigger subassembly 14 is also implemented as a module that can be readily installed into the assault weapon module 4.

In an alternative embodiment, the pushbutton trigger assembly 14 of FIG. 1 is replaced by a trigger arrangement designed for remote triggering, such as upon the application of electrical control pulses or the actuation of a cable or the like.

By way of example, the operation of the multipurpose weapon shown in FIG. 1 may be explained assuming that the user is right-handed, i.e., the user's right hand is utilized to actuate the trigger of the large-caliber rifle 2. During firing operation, the right or trigger hand of the user grips the grip piece 6. In this position, the user's right index finger is ready for operating the trigger 10 of the large-caliber rifle 2. The left or non-trigger hand of the user supports the front portion of the weapon by holding either the magazine 12 of the assault weapon or the hand guard 23 proximate to the magazine 12, with the shoulder support 16 of the weapon drawn firmly against the user's shoulder.

In this ready-to-fire position, the thumb of the user's left or non-trigger hand, which is normally in gripping engagement about the rod magazine 12 of the assault weapon module 4 from the left side, may be utilized to actuate the pushbutton trigger 21. A second pushbutton trigger arrangement may also be provided on the right side of the weapon permitting selection of one or more non-trigger hand fingers resting on the right side of the weapon to operate the trigger.

In the case of a left-handed user, the placement of the hands of the user are interchanged from that described above. Preferably the pushbutton trigger arrangement is arranged on both sides of the assault weapon module 4 so that the combined weapon can be readily used by both right-handed and left-handed users. By virtue of the trigger arrangement of the assault weapon, the user is constantly ready to fire both the large-caliber self-loading rifle 2 or the assault weapon module 4.

In the preferred embodiment, the sighting device is designed for use with both the large-caliber rifle module and the assault weapon module. This arrangement is advantageous in that the user can deliver two different types of projectiles without having to change his position relative to the weapon. The elimination of the need for separate sighting devices also reduces the weight of the weapon and makes the weapon easier to handle and maintain. Preferably the sighting device is adapted to display a view arranged for both the larger-caliber rifle and the assault rifle to allow the user to make a precision shot with either rifle module at any time without having to shift his grip or move his head.

When the multipurpose weapon is mounted on a support for shooting, the weapon is positioned such that the hand guard 23 of the assault weapon module 4 rests on the support with its magazine 12 pressed against the support. In this firing position, the non-trigger hand of the user can rest lightly on the large-caliber magazine 8 to operate the trigger and safety pushbuttons 21, 22 of the assault weapon.

The shock absorber 30, which is schematically indicated in FIG. 1, is preferably a hydraulic shock absorber. Nevertheless, simpler shock absorbers, such as a rubber block or a friction damper, may also be used. The shock absorber 30 lengthens the recoil impulse, thereby reducing its magnitude. The shock absorber allows the user to fire high-recoil large-caliber cartridges such as those of the "intelligent ammunition" which may generate intolerable recoil impact if the shock absorber is not used.

According to another embodiment of the invention, the assault weapon module 4 is mounted side-by-side with the large-caliber rifle module 2, instead of in vertical alignment (rack double-rifle arrangement) of the embodiment shown in FIG. 1. In the side-by-side arrangement, the barrels 24, 26 are advantageously positioned at the same height. This configuration reduces the distance between the sighting line and the axis of the barrel 24 of the assault weapon and therefore improves the accuracy of aiming to a certain degree. Mounting the assault weapon module 4 on the side of the large-caliber rifle module 2 may, however, require the modification of the loading lever and/or the ejection arrangement of the assault weapon. For instance, the assault weapon module 4 may be arranged such that its loading lever extends upward and the cartridge ejection is also in the upward direction.

Accordingly, the multi-purpose weapon of the present invention can be configured to provide increased flexibility with a first module having a non-conventional barrel, a stock and a non-conventional firing system providing a trigger that is accessible with a trigger rifle module accessible by the non-trigger hand of the user.

Figure 5:
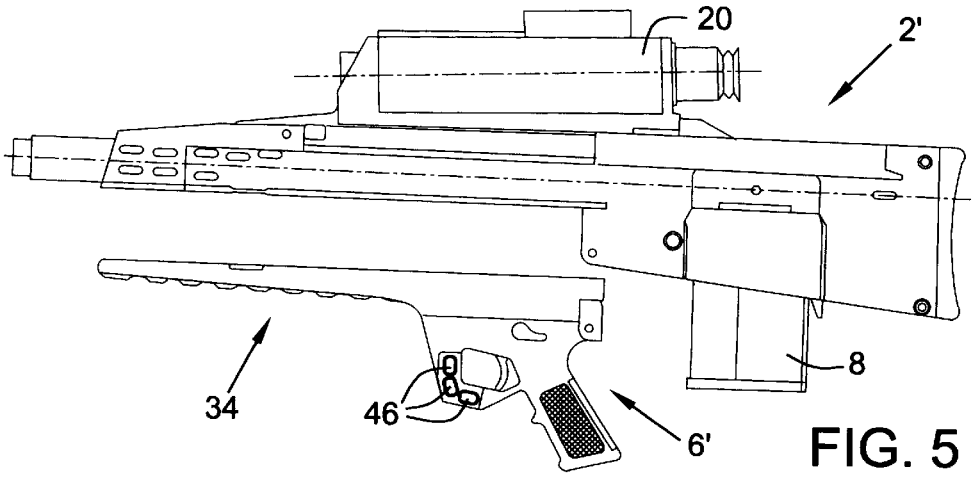
FIG. 5 is a side view of a second embodiment of a multipurpose weapon constructed in accordance with the present invention wherein the detachable secondary module comprises a grip assembly.
Figure 6:
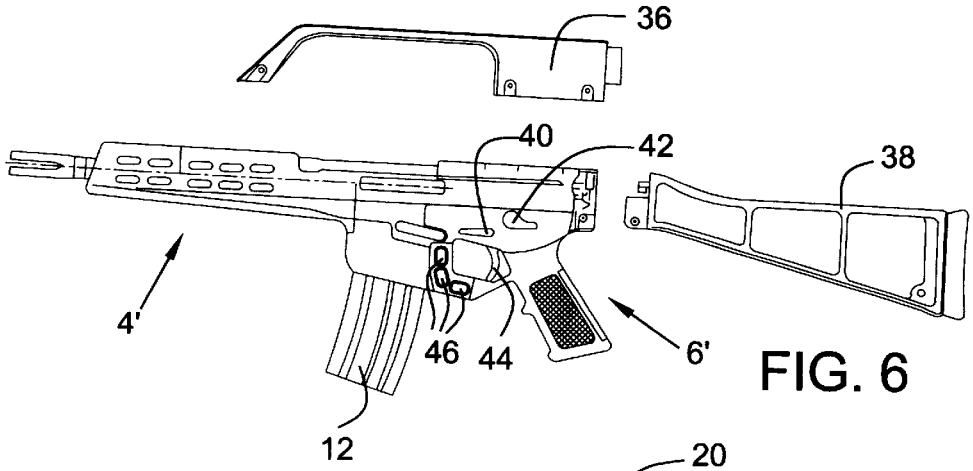
FIG. 6 is a side view of a detachable secondary module comprising a short assault rifle module for use with the multi-purpose weapon of FIG. 5 showing how the secondary module can be converted to function independently an assault rifle.
Figure 7:
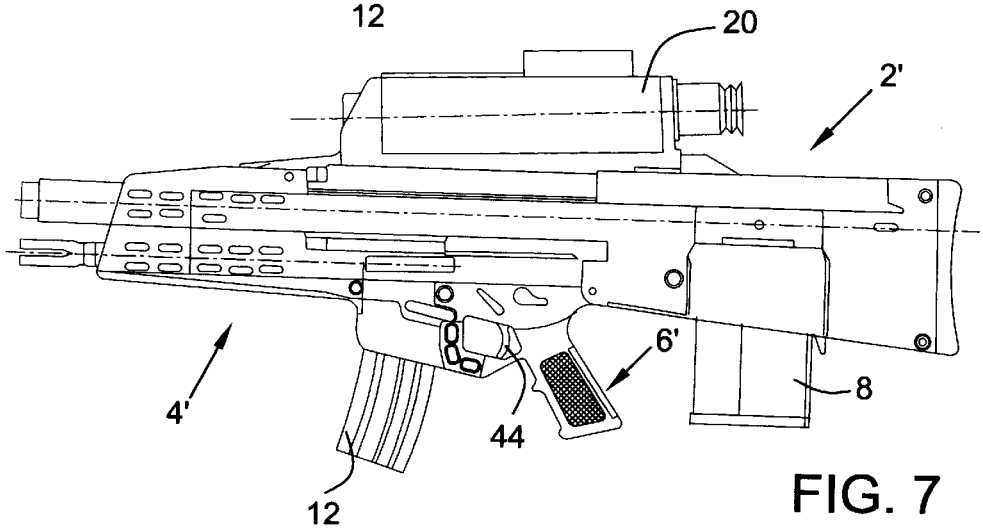
FIG. 7 is a side view showing the multi-purpose weapon of FIG. 5 with the secondary assault weapon module of FIG. 6 attached.

A second exemplary embodiment of the invention is depicted in FIGS. 5 to 7. As with the first embodiment, the multi-purpose weapon includes a large-caliber rifle module to which a quasi-auxiliary or secondary module can be removably attached as desired. As will be appreciated, the secondary module can be mounted using the mounting arrangement described in connection with the FIG. 1–4 embodiment. The second embodiment differs from the first embodiment shown in FIGS. 1 to 4, however, in that the large-caliber rifle module 2' does not have its own grip assembly or its own trigger/safety and in that the assault-rifle module 4' includes an ordinary grip assembly 6'.

Referring now to FIG. 5, the large-caliber rifle module 2' is provided with a sight 20 (such as described above in connection with the FIG. 1–4 embodiment), and includes a barrel adapted to fire spin stabilized projectiles, stock and receiver, and a reloading mechanism 8 such as a box magazine. As explained above, the large-caliber rifle module 2' does not have its own trigger, but rather includes only a firing system having the components necessary for priming and stopping. For example, the large-caliber module only includes a hammer or firing pin that can be shot forward and placed under tension by means of a striker spring. Since the large-bore module 2' does not have its own trigger mechanism, a coupling (not shown) is provided between the large-bore module 2' and the secondary module, which as described below can be either a grip module 34 or a assault-rifle module 4', that is actuated when the secondary module 4', 34 is connected to the large-bore module 2'. As will be understood by those skilled in the art, the coupling transmits the movements of a multi-purpose trigger 44, and optionally of a safety, disposed on the secondary module 4', 34 to the large-bore module 2'. The coupling can, for example, consist of a mechanism including a rod which moves outward from the secondary module 4', 34 when the trigger 44 is actuated and presses against a spring-mounted counter-rod in the large-bore module 2'. Further, electrical signals can be transmitted between the two modules by means of contacts.

To the extent that the multi-purpose rifle is to be used only as a large-caliber rifle, the secondary module can comprise simply a grip assembly which includes the trigger and safety as well as operating elements for the electronics and the sight of the large-bore module. Specifically, FIG. 5 depicts a grip module 34 which can selectively and removably mounted to the large-caliber module 2' so as to be utilized as a secondary module. The grip module 34 comprises a grip 6' with a trigger, a safety lever and control keys 46 for electronic devices. When this grip module 34 is mounted on the large-bore module 2', a large-bore, self-loading rifle is obtained. The coupling, which is described above, and the contacts (not shown) create a controlling connection between the trigger and the large-bore module and between the control keys 46 and their assigned devices of the large-bore module 2'.

In addition to simply a grip assembly for the large-caliber module, the secondary module can also comprise a short assault rifle module 4'. FIG. 6 depicts one embodiment of a short assault-rifle module 4' with a magazine 12 which can be removably mounted, as desired, under the barrel of the large-caliber module 2' as shown in FIG. 7. In accordance with the invention, the grip assembly 6' of the assault-rifle module 4' includes a changeover mechanism by means of which the trigger 44 can optionally be switched to the large-caliber module or to the assault rifle. In particular, the grip assembly 6' comprises a multi-purpose trigger 44, the control keys 46, a module selector 40 and a mode selector 42. The module selector 40 is movable between two positions in order to control whether the multi-purpose trigger 44 is operatively connected to the assault-rifle module 4' or to the large-caliber module 2'. The mode selector 42 also has a number of positions which can be used to selectively set the operating mode of either the assault-rifle module 4' or the large-caliber rifle module, e.g. safe, single fire or burst (of course, the burst mode is only applicable to the assault-rifle module 4'). As will be appreciated, the grip assembly may also include elements which establish an operative connection between the control keys 46 and their assigned electronic devices on the large-caliber module 2'.

In keeping with a further aspect of the present invention, the assault-rifle module 4' can be easily converted for use independent from the large-caliber module. Specifically, as shown in FIG. 6, a carrying handle 36 with a conventional assault rifle sight can be mounted on the top of the assault-rifle module 4'. The carrying handle 36 can also be used to cover the contacts used to establish an electrical connection between the assault-rifle module 4' and the large-caliber module 2'. Moreover, an assault rifle butt 38 can be selectively mounted at the rear of the assault-rifle module 4'. The butt 38, which can be either rigid or extendible, can also be used to cover the parts of the coupling described above that are disposed in the assault-rifle module 4'. Thus, the assault rifle module 4' can be converted to a rifle which is fully equivalent to a conventional assault rifle. Of course, when the assault-rifle module is being used in this manner, the module selector 40 must remain set to control the assault-rifle module 4'.

From the foregoing it can be seen that the optimum multi-purpose rifle for a given situation can be assembled quickly and easily from the modular components. Accordingly, a user of the multi-purpose weapon of the present invention is able to assemble the optimum weapon for a given set of circumstances on his own from a kit which can be carried in the vehicle or by the user. For example, if the user is going to proceed on foot the assault-rifle module 4' may be used independently while the more sensitive and costly large-caliber module 2', with its electronics, remains protected in a carrying case. If the large-bore module is to be used from well-prepared, fixed positions, then the grip module 6' will suffice as the secondary module such that the weapon functions only as a large-caliber rifle, since machine guns will most likely be present to repel a potential assault. However, when the multi-purpose weapon of the present invention must be used during a raid, such as to take out an enemy artillery position, then the assault-rifle module 4' is preferably attached to the large-caliber module. Finally, the large-bore module 2' can be left behind in an emergency, since it cannot be fired on its own without a secondary module.

What is claimed is:

1. A multipurpose weapon comprising:

a large-caliber rifle module having a housing with a shoulder support at one end, a longitudinally extending large-caliber barrel contained in the housing for discharging relatively larger caliber projectiles; and a secondary module including a hand support, a barrel for discharging relatively smaller caliber assault rifle cartridges and a trigger mechanism which upon actuation discharges either the large-caliber rifle module or the secondary module, and a coupling arrangement for releasably attaching the secondary module to the large-caliber rifle module such that the secondary module is selectively detachable and operable independently from the large caliber rifle module and reattachable thereto.

2. The invention according to claim 1 further including a sighting device for use with both the large-caliber rifle module and the secondary module.

3. The invention according to claim 1 wherein the trigger mechanism includes a module selector for selectively switching the trigger mechanism between actuating discharge of the large-caliber rifle module and actuating discharge of the secondary module.

4. The invention according to claim 1, wherein the secondary module is removably mounted to the large-caliber rifle housing by a slide-on mounting arrangement.

5. The invention according to claim 1, further including a shock absorber disposed adjacent to the shoulder support for recoil absorption.

6. The invention according to claim 5, wherein the shock absorber is a hydraulic shock absorber.

7. The invention according to claim 1, wherein the secondary module is mounted substantially below the barrel of the large-caliber module.

* * * * *